US006681728B2

(12) United States Patent
Haghgooie et al.

(10) Patent No.: US 6,681,728 B2
(45) Date of Patent: Jan. 27, 2004

(54) METHOD FOR CONTROLLING AN ELECTROMECHANICAL ACTUATOR FOR A FUEL AIR CHARGE VALVE

(75) Inventors: Mohammad Haghgooie, Ann Arbor, MI (US); Anna Stefanopoulou, Ann Arbor, MI (US); Katherine Peterson, Ann Arbor, MI (US); Thomas William Megli, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 09/682,987

(22) Filed: Nov. 5, 2001

(65) Prior Publication Data

US 2003/0084860 A1 May 8, 2003

(51) Int. Cl.[7] ..... F01L 9/04
(52) U.S. Cl. ..... 123/90.11; 251/129.1
(58) Field of Search ..... 123/90.11; 251/129.1, 251/129.15, 129.16

(56) References Cited

U.S. PATENT DOCUMENTS 4,475,690 A * 10/1984 Hascher-Reichl et al. ..... 239/585.3
6,003,481 A 12/1999 Pischinger et al.
6,152,094 A 11/2000 Kirschbaum
6,176,207 B1 1/2001 Wright et al.
6,176,208 B1 * 1/2001 Tsuzuki et al. ..... 123/90.11
6,196,172 B1 3/2001 Cosfeld et al.
6,234,122 B1 5/2001 Kirschbaum et al.
6,308,667 B1 * 10/2001 Tsai et al. ..... 123/90.11
6,354,563 B1 * 3/2002 Yoeda et al. ..... 123/90.11
6,405,706 B1 * 6/2002 Hammoud et al. ..... 123/316
6,412,456 B2 * 7/2002 Kumaki et al. ..... 123/90.11

FOREIGN PATENT DOCUMENTS

DE 3500530 A1 * 7/1986 ..... F01L/09/04

OTHER PUBLICATIONS

"Modern Control Theory", "Classical Feedback Control With Metlab", Boris J. Lurie et al, 2000 Marcel Dekker Inc., New York, pp. 253–255.

* cited by examiner

*Primary Examiner*—Thomas Denion
*Assistant Examiner*—Jaime Corrigan

(57) ABSTRACT

A method for controlling movement of an armature for an electromagnetic valve actuator. The armature moves between pole faces of juxtaposed solenoid coils. Voltage applied to armature capturing coil is varied in a closed-loop fashion as the armature moves through a flux initialization phase, followed by an armature landing phase whereby a soft landing of the armature is achieved during valve opening movement and valve closing movement.

12 Claims, 4 Drawing Sheets

METHOD FOR CONTROLLING AN ELECTROMECHANICAL ACTUATOR FOR A FUEL AIR CHARGE VALVE

BACKGROUND OF INVENTION

1. Field of the Invention

The invention relates to camless valve actuators, particularly valve actuators for automotive vehicle internal combustion engines.

2. Background Art

Internal combustion engines for automotive vehicles have power cylinders and piston assemblies that define air/fuel combustion chambers. Each chamber has at least one air/fuel intake valve and at least one exhaust valve. In the case of a four-stroke cycle engine, the intake valve is opened during the intake stroke to admit an air/fuel mixture; and it is closed during the compression, power and exhaust strokes of the piston. The exhaust valve is opened during the exhaust stroke of the piston; and it is closed during the compression, power and intake strokes. The intake and exhaust valves are sequentially operated in known fashion to effect the usual Otto cycle as power is transferred from the pistons to the engine crankshaft.

Typically, the intake and exhaust valves are actuated by a camshaft that is connected driveably to the crankshaft with a 2:1 driving ratio.

In the case of a camless valve train, electromagnetic actuators for the intake and exhaust valves have been used for sequentially opening and closing the valves. Electromagnetic actuators for camless valve trains typically have two electromagnets, a closing magnet and an opening magnet, together with an armature situated between opposed pole surfaces. The armature is designed to move between the pole surfaces against forces established by a valve closing spring and a valve opening spring. The spring forces act in opposition, one with respect to the other.

Electromagnetic forces developed on the armature oppose the spring forces. In a non-energized state, the armature is held in equilibrium position between the pole surfaces.

One of the electromagnets has a closing coil, which, when energized, holds the armature against its pole surface. When the closing coil is switched off, the opposing electromagnet, which is an opening coil, is energized, thereby driving the armature to a valve opening position.

When the valve is actuated, the armature and the valve are driven at high velocities as they move toward the opening coil. It is possible, therefore, for the armature to have high impact energy as it engages the opening coil pole face. Similarly, when the closing coil is actuated, the armature may be subjected to high impact energy as the valve is closed. High impact energy results in excessive noise as well as wear on the valves.

If a camless valve train of known designs is calibrated to achieve optimum impact velocities for the purpose of reducing noise and wear, variations in the operating parameters and operating conditions of the engine (including valve wear, temperature changes and hydrocarbon debris buildup) will cause the control of the position and velocity of the armature to deviate from an optimum calibration.

Attempts that have been made to provide more consistent control of electromagnetic valve actuators include the design disclosed in U.S. Pat. No. 6,234,122. Variations in operational system parameters are accounted for in the design of the '122 patent by sensing a change in the inductance of the electromagnetic coil windings as a measure of impact velocity. A predetermined value of the impact velocity of the armature on the electromagnet is adjusted to a so-called set point by controlling the supply of energy to the electromagnet based on a change in inductance of the electromagnet.

Another attempt to control movement of the armature of an electromagnetic actuator is described in U.S. Pat. No. 6,196,172. That design relies upon a control movement of the actuator armature in accordance with a desired, predetermined trajectory. The acceleration of the armature is calculated as a derivative of the armature velocity. The control of the velocity is achieved in an open-loop fashion determined by operating variables during calibration of the actuator in accordance with the so-called desired trajectory.

In a design described in U.S. Pat. No. 6,003,481, the motion of the armature in the final phase of the armature's motion is achieved by providing an additional mass that is engaged by the armature when the valve approaches the fully opened position or the fully closed position. The additional mass modifies the opening velocity and the closing velocity of the valve. Movement of the additional mass is modified by a cushioning spring.

SUMMARY OF INVENTION

The invention comprises a control method for an electromagnetic camless valve train that can be adaptively calibrated for optimal performance. The method of the invention achieves a so-called soft landing of the valve, which avoids the high impact velocities during valve opening and closing. The control method of the present invention reduces impact velocity of the armature as it approaches the catching coil, from about 1 meter per second to 0.1 meter per second for a valve in a contemporary automotive engine. The soft landing velocity relative to the catching coil achieved by the controller is obtained using an electromagnetic PWM signal based upon an optimal proportional control of the position and the instantaneous velocity of the armature, as well as the current in the coil, in a closed-loop, full-state feedback fashion. The controller is characterized by two different stages based upon armature position; i.e., a flux initialization stage and a landing stage. Each stage has its unique function in the control of the optimal overall landing characteristics of the valve and the armature.

In practicing the method of the invention, a position sensor is used to measure the displacement of the armature as the opening and closing coils are alternately activated and deactivated to capture the armature. The valve, which is mechanically coupled to the armature, is biased toward an intermediate position between the coils by at least one spring. Electrical current supplied to each coil is measured as the coil is activated. Current for each coil also can be determined as an observed current that would be a function of coil inductance, voltage and resistance. The instantaneous velocity of the armature is computed as the armature moves toward the catching coil in response to alternating activation of the coils. The activating voltage is computed in a closed-loop fashion as a function of current, displacement and armature velocity whereby the armature approaches the coil pole faces with a controlled movement to achieve reduced impact velocity.

DETAILED DESCRIPTION

Figure 1:
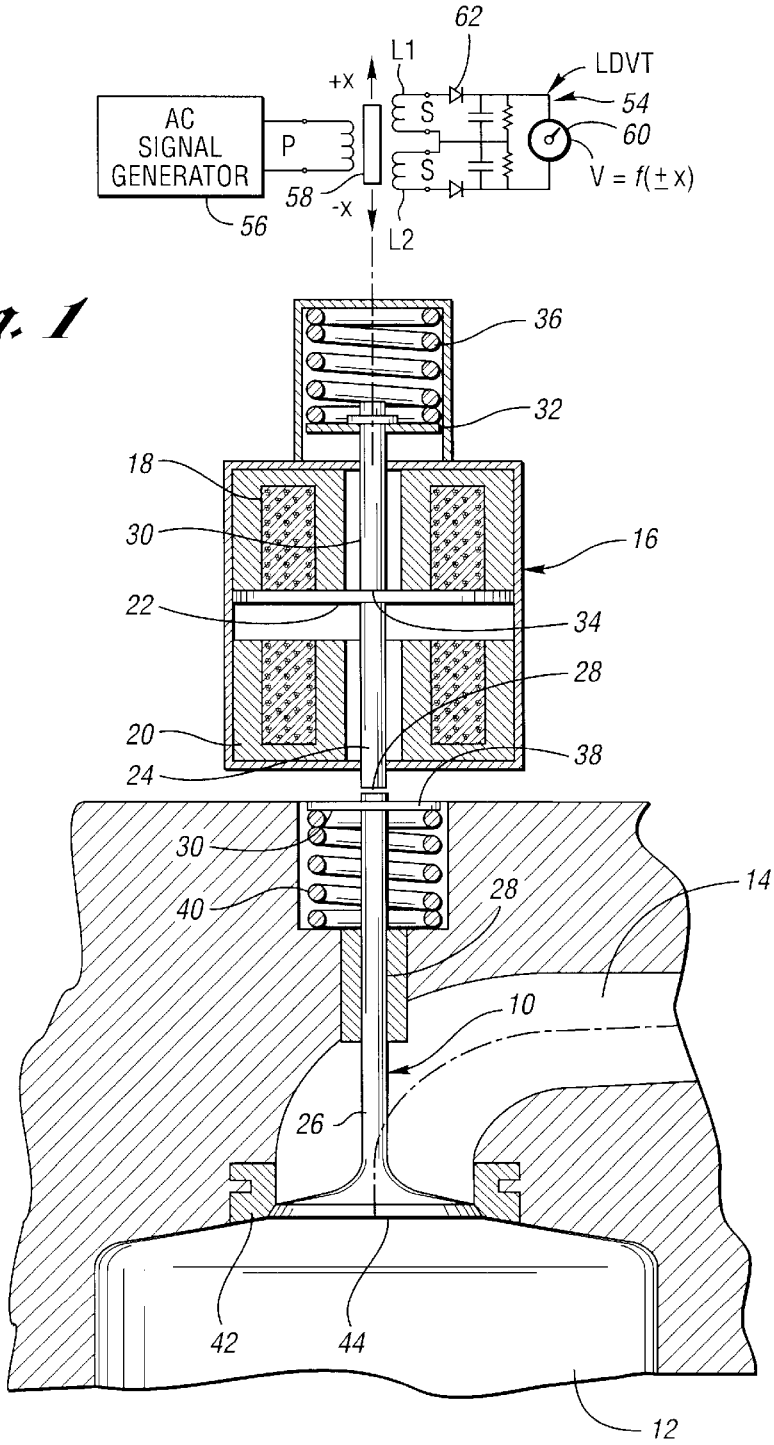
FIG. 1 is a schematic assembly view of an electromagnetic actuator for a camless valve train in an internal combustion engine capable of being controlled by the method of the invention.

FIG. 1 shows an electromagnetic actuator for controlling an engine valve 10, which may be an air/fuel mixture intake valve or a combustion gas exhaust valve. An engine cylinder combustion chamber is shown at 12, and a gas exchange passage controlled by the valve 10 is shown at 14. The actuator for the valve 10, shown at 16, comprises a closing coil 18 and an opening coil 20. The coils are situated in juxtaposed relationship with the pole faces spaced apart, one with respect to the other. The space between the pole faces is occupied by an armature 22. A core piece 24, connected to the armature 22, is aligned with the stem of valve 10, as shown at 26. A calibrated space or lash 28 is provided between the core piece 24 and the stem 26.

Another core piece 30 within the closing coil, which is engageable at 34 with armature 22, carries a spring seat 32 at one end.

Spring seat 32 is engaged by upper spring 36, which urges the armature in a downward direction. A valve spring seat 38 carried by the valve stem 26 is urged in an upward direction by valve spring 40. A valve seat 42 is engaged by valve head 44 when the valve 10 is in the closed position.

At the beginning of the operating cycle for the actuator of FIG. 1, the armature 22 is held in the upward position by the closing coil 18, which compresses the upper spring 36. The valve 10 at that time is held in the closed position by the valve spring 40.

When the voltage to the closing coil is switched off, the armature 22 is released. It then is moved toward a neutral position by the upper spring 36. The armature 22, as it moves toward the opening coil, opens the valve 10. The armature then is caught by the flux afield of the opening coil during a so-called landing phase of the actuator function. The armature, after being caught, is held in the lower position by the opening coil, thereby causing the valve to remain in its open position.

A two-stage closed-loop controller achieves consistent valve opening and closing. This is in contrast to prior art designs, which typically use either open-loop catching voltage or current control functions to both catch and hold the armature. Both of these are independent of position and velocity. Consistent opening and closing of the valve can be achieved using such known open-loop designs, but resulting impact velocities can be unacceptable because of the resulting valve noise and valve wear. Impact velocities in such prior art designs can be as high as 1 meter per second.

In contrast, by using the closed-loop, two-stage controller of the invention, the average impact velocity of the opening phase and the closing phase can be approximately 0.1 meters per second.

Figure 6:
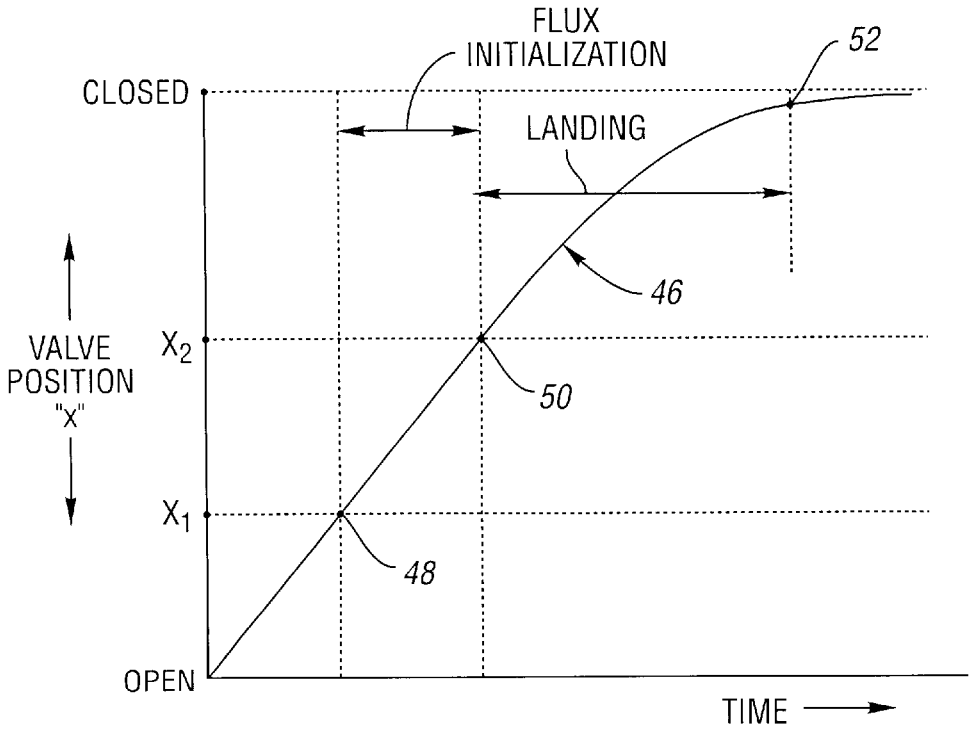
FIG. 6 is a plot of valve position versus time during movement of the valve through a flux initialization stage and a.valve landing stage.

FIG. 6 shows a plot of valve position versus time for the closed-loop, two-stage controller of the invention. The valve can move between an open position and a closed position, as indicated by the plot of progressively decreasing slope shown at 46 in FIG. 6. Following the opening of the valve, the flux initialization stage will begin when the valve has moved a distance $X_1$, as shown at 48 in FIG. 6. The flux initialization stage ends at valve position $X_2$, as shown at 50. When the valve reaches position $X_2$, the landing phase begins. It continues as long as the valve has not landed. The landing point is shown at 52.

In each stage in the operation of the closed-loop controller, the voltage command signal generated by the controller is equal to:

$$\text{Voltage}=K_i(i_{desired}-i_{measured})+K_x(x_{desired}-x_{measured})+K_v(v_{desired}-{}_{measured})$$

In the preceding equation, "i" is the current in the catching coil, which would be the closing coil during closing of the valve and the opening coil during opening of the valve. The term "x" is the distance between the armature and the catching coil. The term "v" is the velocity of the armature.

In the preceding equation, "$K_i$", "$K_x$" and "$K_v$" are constants that are determined using a known linear quadratic regulator optimization technique (LQR). When the armature is released initially, the catching coil has little or no influence or authority over the armature since the distance is too great to be influenced by the magnetic flux field of the catching coil. It is not practical, therefore, to attempt to affect the valve motion with the catching coil until the armature moves closer to the pole face. Because of the slow current response characteristic of electromagnetic actuators, it is necessary, furthermore, to use the time interval between points 48 and 50 to bring the current up to a value near the catching level. Otherwise, when the armature is near the catching coil, the controller will not be able to bring the magnetic force up quickly enough to catch the armature.

Figure 4:
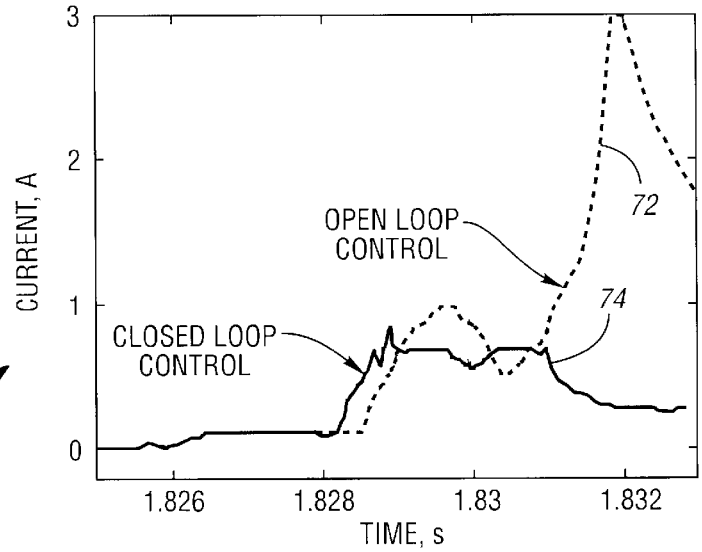
FIG. 4 is a plot of the current in the coils versus time for a closed-loop control together with an open-loop control superimposed on the closed-loop control plot for purposes of comparison.

The current is brought up, as shown in FIG. 4, during the flux initialization stage using a closed-loop signal. The controller drives the current near the nominal catching level, but the current is adjusted slightly based upon the armature position and the velocity to account for variations in operating conditions during the transition.

When the armature is 1 mm or less from the seating position, the controller enters the landing stage, as indicated in FIG. 6. This stage ensures that the closing of the valve will occur with minimal contact velocity. This is achieved by regulating the current as the armature lands based upon the measured current, displacement and velocity.

The displacement, or the distance between the armature and the catching coil, may be determined by a displacement sensor such as the linear variable differential transformer indicated schematically in FIG. 1 by reference numeral 54. The linear variable differential transformer (LVDT) may comprise an AC voltage signal generator 56, inductance coils L1 and L2, a movable core 58, which is mechanically connected to armature 22, and a DC voltage output represented by the symbol V as shown at 60. The AC signal is converted to a DC reading indicative of displacement using diodes 62. The observed velocity term $V_{measured}$ can be obtained by calculating the derivative of the displacement term.

If an attempt were to be made to control movement of the armature using an open-loop technique, as in the case of prior art devices, it would be necessary to choose at the outset of the operating cycle a voltage for a given set of operating variables. Although the voltage that is chosen may be optimal for a given set of engine variables, it may be too low to capture the armature for landing the valve if the engine variables should change due to wear or temperature changes, or due to changes in engine operating conditions. Likewise, if the open-loop voltage is too high following variations in engine variables, the impact velocity will be too high, thus causing excessive wear and noise.

The observed velocity term $V_{measured}$ in the preceding equation, which is obtained by a derivative calculation as mentioned previously, can be weighted in accordance with an observer model that is structured using empirical data during testing.

The constants $K_i$, $K_x$ and $K_v$ in the preceding equation are chosen, as mentioned previously, using LQR optimization. It is during this procedure that the values for K can be varied so that the objective will match an ideal model determined by bench tests. In this way, the constants can be varied to achieve an optimal effect, notwithstanding system non-linearities.

There will be a set of constants that effect optimal voltage throughout the flux initialization phase and a different set of constants that effect optimal velocity throughout the landing phase before the armature is landed. The constants are chosen during calibration based upon information developed by an observer model. The observer model takes into account deviations of the observed data due to engine variables such as wear, temperature, etc.

Small changes in voltage have a high degree of influence on armature velocity. The closed-loop control accommodates for changing engine variables as well as for changing operating conditions.

This LQR optimization technique is a known feedback control theory. It is described, for example, in a text entitled "Modern Control Theory", which contains a classical feedback control theory using MATLAB software. The text is authored by Borris J. Lourie and Paul J. Enright. The technique is described at pages 253–255. The text is published by Marcel Dekker, Inc. of New York. The first edition was published in 2000. Reference may be made to that text for purposes of supplementing this description.

After the armature has landed, it may be held in place against the pole face by a small open-loop current until the cycle begins again.

Figure 2:
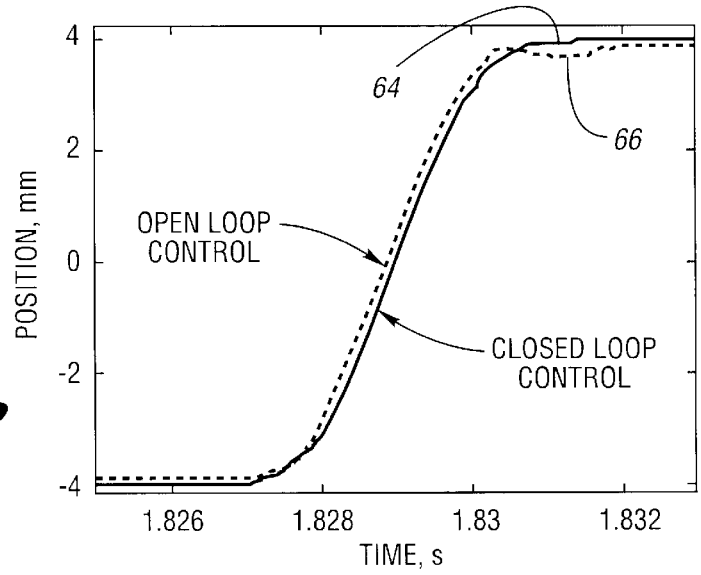
FIG. 2 is a plot of armature position versus time for a controller having a closed-loop control of the voltage for the electromagnets as the armature moves between the open and closed positions, together with a plot of an open-loop control superimposed on the closed-loop control plot for purposes of comparison.

FIG. 2 shows a comparison between an open-loop control and a closed-loop control. FIG. 2 is a plot of the position of the armature versus time. When the time is about 1.829 seconds from the initial point, the open-loop control will begin to decelerate the armature. In the case of a closed-loop control, the position of the armature near the end of its travel is indicated at 64. For an open-loop control, the corresponding position would be illustrated at 66. Thus, a much more precise control of the position can be achieved using the closed-loop control.

Figure 3:
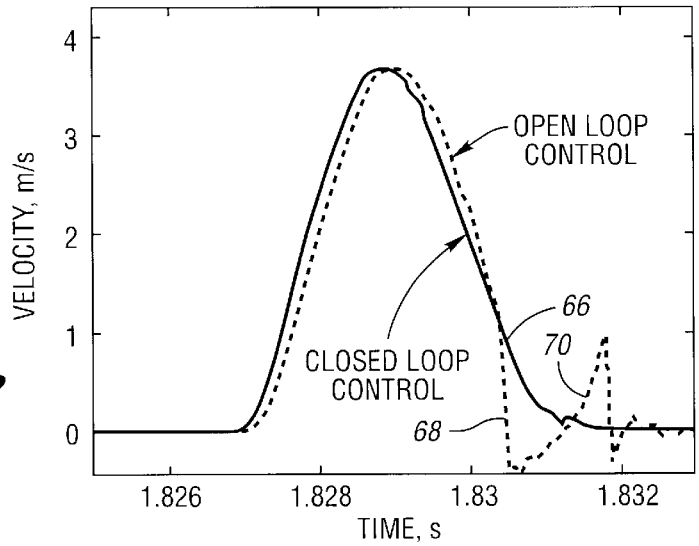
FIG. 3 is a plot of the armature velocity versus time for a controller having a closed-loop control and a superimposed open-loop control plot for purposes of comparison.

The velocity versus time relationship is illustrated in FIG. 3. As the armature approaches the end of the landing phase, the closed-loop control will modify the velocity in a controlled fashion, as indicated at 66. This would be in contrast to the lack of control of the velocity if an-open-loop controller were used, as demonstrated by the velocity curve 68. This would be evidenced by a velocity reversal, or bouncing. A reversal in the velocity would occur, as indicated at 70 in FIG. 3, after the velocity value becomes negative. Oscillations of the velocity plot would take place until the velocity is stable at the zero velocity level.

FIG. 4 shows the variations of current in the catching coil when the armature approaches the end of the landing phase. In the case of an open-loop controller, a large current peak would occur as shown at 72, as compared to the closed-loop control plot shown at 74.

Figure 5:
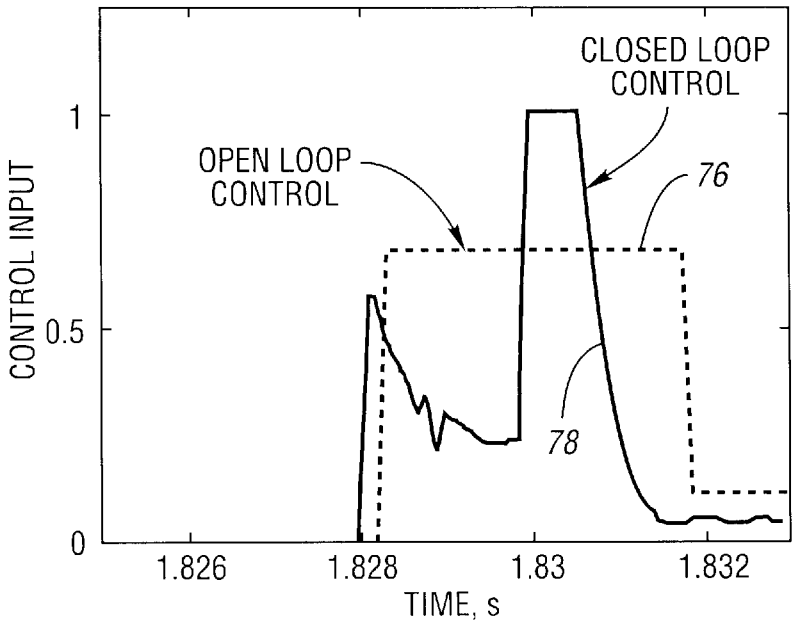
FIG. 5 is a plot of control input voltage versus time for a closed-loop control together with a plot of an open-loop control superimposed on the closed-loop control plot for purposes of comparison.

FIG. 5 is a plot of the control input voltage. In the case of the open-loop control, a constant input voltage 76 is applied to the catching coil. It continues until the end of the landing phase is approached. If changes in the operating variables occur, the open-loop control value chosen at 76 may be too high or too low. This characteristic shown at 76 is in sharp contrast to the closed-loop control characteristic shown at 78 in FIG. 5 where the control voltage is continuously calculated to provide the optimum voltage versus time characteristic regardless of changes in operating variables during the landing phase.

Figure 7:
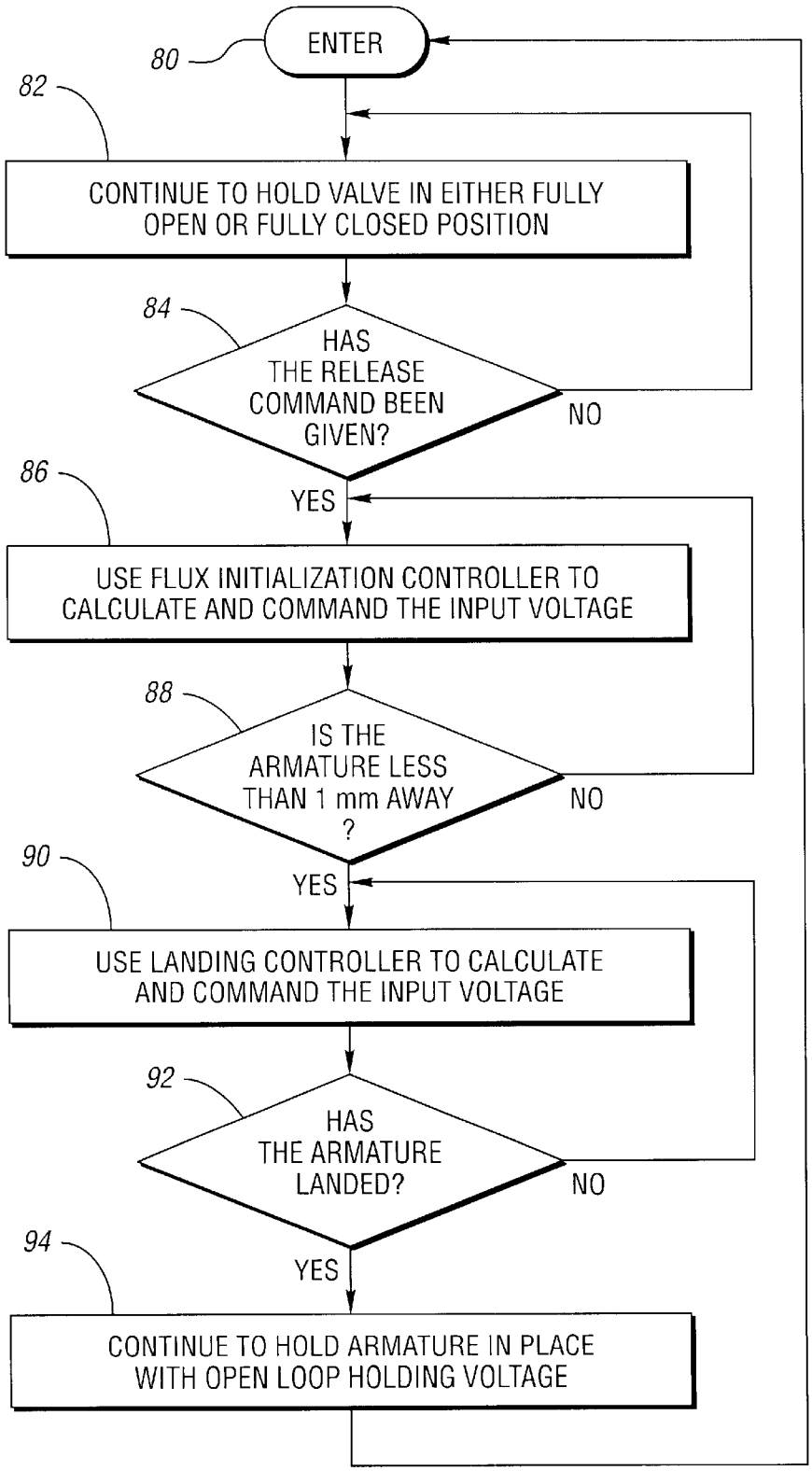
FIG. 7 is a flow diagram illustrating the control strategy for the camless valve train control method of the invention.

The control strategy for the controller of the invention is illustrated in flow diagram form in FIG. 7. The control strategy is initialized at 80. The armature can be held, as shown at action block 82, in either the fully opened position or the fully closed position depending upon whether the opening coil is activated or the closing coil is activated. An inquiry then is made at 84 to determine whether a release command has been initiated. If no release command has been initiated, the routine will not proceed further. If the release command has been given by the engine controller, the flux initialization phase begins, as shown at action block 86, during which time the input voltage is calculated.

As the routine continues, an inquiry is made at 88 to determine whether the armature is less than 1 mm from the pole face for the coil that is being approached. The routine will not continue unless the armature is less than 1 mm from its landed position.

If the armature is less than 1 mm from the landed position, the landing control calculates at 90 the input voltage that will achieve the voltage plot shown at 78 in FIG. 5. At that stage, it is determined at 92 whether the armature has landed. If it has not landed, the routine will continue to calculate an input voltage command for the controller. If the armature has landed, as determined by the position sensor 54, the controller will continue to supply an open-loop voltage to the holding coil, as shown at action block 94.

Although one embodiment of the invention has been described, it will apparent to persons skilled in the art that modifications may be made without departing from the scope of the invention. All such modifications and equivalents thereof are intended to be covered by the following claims.

What is claimed is:

1. A method for controlling an electromagnetic actuator for a gas charge valve having a valve head portion arranged in registry with a valve port in a gas flow passage and a stem portion, the actuator having an opening electromagnetic coil and a closing electromagnetic coil with pole faces in spaced, juxtaposed relationship in opposed sides of an armature, the armature being mechanically coupled to the stem portion, and at least one mechanical spring acting on the armature to bias it toward a position intermediate the pole faces; the method comprising the steps of:

measuring by means of a position sensor the displacement of the armature as the opening and closing coils are activated and deactivated;

determining the electrical current supplied to each coil as the coil is activated;

computing the instantaneous velocity of the armature as the armature is moved in response to alternating activation of the coils;

computing a coil activating voltage as a closed-loop function of current, displacement and armature velocity whereby the armature approaches the pole faces with a controlled movement characterized by reduced impact velocity to reduce valve noise and wear.

2. The method set forth in claim 1 wherein movement of the armature between the opening coil and the closing coil occurs in a flux initialization stage followed by a soft landing stage characterized,by reduced impact velocity of the valve as the valve head is seated.

3. The method set forth in claim 2 wherein the voltage is computed as a function of variables comprising current, displacement and armature velocity, each variable being modified by a multiplier constant chosen to conform to test model data, the multiplier constants for each stage being distinct from the multiplier constants for the following stage whereby optimum velocity of the armature in each stage is achieved.

4. The method set forth in claim 3 wherein the position sensor is a linear variable differential transformer having an inductance core piece mechanically coupled to the valve stem.

5. The method set forth in claim 4 including the step of energizing each coil with an open-loop holding current as the coil captures the armature.

6. The method set forth in claim 2 including the step of energizing each coil with an open-loop holding current as the coil captures the armature.

7. The method set forth in claim 3 including the step of energizing each coil with an open-loop holding current as the coil captures the armature.

8. The method set forth in claim 1 including the step of energizing each coil with an open-loop holding current as the coil captures the armature.

9. A method for controlling an electromagnetic actuator for a gas charge valve having a valve head portion arranged in registry with a valve port in a gas flow passage and a stem portion, the actuator having an opening electromagnetic coil and a closing electromagnetic coil with pole faces in spaced, juxtaposed relationship in opposed sides of an armature, the armature being mechanically coupled to the stem portion, and at least one mechanical spring acting on the armature to bias it toward a position intermediate the pole faces; the method comprising the steps of:

measuring by means of a position sensor the displacement of the armature as the opening and closing coils are activated and deactivated;

determining the electrical current supplied to each coil as the coil is activated, the activated coil being a catching coil that attracts the armature;

computing the instantaneous velocity of the armature as the armature is moved in response to alternating activation of the coils;

computing a coil activating voltage as a closed-loop function of current, displacement and armature velocity, the closed-loop function being expressed as:

$$\text{Voltage}=K_i(i_{desired}-i_{measured})+K_x(x_{desired}-x_{measured})+K_v(v_{desired}-V_{measured})$$

whereby the armature approaches the pole faces with a controlled movement characterized by reduced impact velocity to reduce valve noise and wear.

10. The method set forth in claim 9 wherein movement of the armature between the opening coil and the closing coil occurs in a flux initialization stage followed by a soft landing stage characterized by reduced impact velocity of the valve as the valve head is seated.

11. The method set forth in claim 10 wherein the voltage is computed as a function of variables comprising current, displacement and armature velocity, each variable being modified by a multiplier constant chosen to conform to test model data, the multiplier constants for each stage being distinct from the multiplier constants for the following stage whereby optimum velocity of the armature in each stage is achieved.

12. The method set forth in claim 11 wherein the position sensor is a linear variable differential transformer having an inductance core piece mechanically coupled to the valve stem.

* * * * *

UNITED STATES PATENT AND TRADEMARK OFFICE

CERTIFICATE OF CORRECTION

PATENT NO. : 6,681,728 B2
DATED : January 27, 2004
INVENTOR(S) : Katherine Peterson et al.

It is certified that error appears in the above-identified patent and that said Letters Patent is hereby corrected as shown below:

Title page,
Item [75], Inventors, should read as follows:
-- Katherine Peterson, Ann Arbor, MI
Anna Stefanopoulou, Ann Arbor, MI
Thomas William Megli, Dearborn, MI
Mohammad Haghgooie, Ann Arbor, MI --

Signed and Sealed this

Twentieth Day of April, 2004

JON W. DUDAS
*Acting Director of the United States Patent and Trademark Office*